United States Patent [19]

Ozawa

[11] Patent Number: 4,858,541

[45] Date of Patent: Aug. 22, 1989

[54] APPARATUS FOR TERMINATING THE LAST STITCH AT A PREDETERMINED POINT

[75] Inventor: Masato Ozawa, Hino, Japan

[73] Assignee: Tokyo Juki Industrial Co., Ltd., Tokyo, Japan

[21] Appl. No.: 160,195

[22] Filed: Feb. 25, 1988

[30] Foreign Application Priority Data

Feb. 25, 1987 [JP] Japan ..... 62-42232

[51] Int. Cl.[4] ..... D05B 19/00; D05B 27/22

[52] U.S. Cl. ..... 112/121.11; 112/272; 112/275; 112/315

[58] Field of Search ..... 112/121.11, 275, 277, 112/315, 272, 262.1, 2, 314

[56] References Cited

U.S. PATENT DOCUMENTS 4,495,877 1/1985 Willenbacher ..... 112/121.11

4,722,291 2/1988 Goto ..... 112/121.11 X 4,732,095 3/1988 Saito et al. ..... 112/121.11

*Primary Examiner*—Peter Nerbun

*Attorney, Agent, or Firm*—Morgan & Finnegan

[57] ABSTRACT

An apparatus for terminating the last stitch at a predetermined point including two workpiece-end detectors, one working to reduce the stitching speed and the other working to terminate the last stitch at the predetermined point with reduced speed. Where the number of stitches (D) to be conducted at the reduced speed exceeds number of stitches (R) necessary to reduce the speed, stitching without reducing speed continues and the number of stitches is operated as (D−R), and then the speed is reduced. Thus, stitching speed is increased. The above processes are automatically conducted through a CPU (Central Processing Unit) by input of the necessary data, namely, the original stitch pitch (P), the margin distance (a), the number of stitches (R) necessary to reduce speed, etc.

2 Claims, 6 Drawing Sheets

APPARATUS FOR TERMINATING THE LAST STITCH AT A PREDETERMINED POINT

BACKGROUND OF THE INVENTION

This invention relates to apparatus for terminating the last stitch at a predetermined point using a workpiece-end detector and, more particularly, this invention is applicable where a sewing machine is running at high speed of around 5,000 s.p.m. (strokes per minute).

According to the conventional type of apparatus for terminating the last stitch, a workpiece-end detector is located in the counter-feed direction from the needle entry, and when the workpiece-end detector detects the end of workpiece, the detector sends signals to reduce the stitching speed and to adjust the current stitch pitch so that the last stitch terminates exactly at a predetermined point.

Referring to FIG. 2B, when the workpiece-end detector 19 detects the end of the workpiece, considering to the distance M which is between the needle entry 11 and the workpiece-end detector 19, margin "a" of predetermined point E, and the current stitch pitch P, the required number of stitches to terminate the last stitch at the predetermined point E will be operated, namely $(M-a)/P$. This operated number of stitches, $(M-a)/P$, should be larger than the number of stitches required to stop the machine by reducing the speed gradually. It is impossible to terminate the last stitch at the predetermined point within less than the number of stitches required with speed gradually decreasing from the view point of mechanical construction, so the $(M-a)/P$ value must be larger than this required number of stitches.

According to test results, when the sewing machine is running at 1500 s.p.m., at lease five more stitches are required to stop the machine. In such a case, the required number of stitches for stopping is five. However, the larger the $(M-a)/P$ value, the larger the summation of errors per each stitch pitch will become. Thus, the last stitch will deviate from the predetermined point.

Such difficulties illustrate a contradiction in the prior art relating to termination of the last stitch at a predetermined point. Although the stitch pitch was adjusted from 2mm to 1.5mm, the adjusted stitch pitch may not stitch at a 1.5mm pitch because the workpiece stretches due to its elastic nature. Therefore, the actual stitch pitch may be 1.3mm. In such a case, if $(M-a)/P$, namely the number of stitches, is large, the last stitch will deviate far from the predetermined point. High speed performance of the sewing machine is of course desirable. However, the more the stitching speed increases, the more the $(M-a)/P$ value increases. On the other hand, in order to terminate the last stitch at the predetermined point precisely, the value $(M-a)/P$ should be small. Thus, there is a contradiction.

Considering the above points, although the sewing machine is capable of operating at 5,000 s.p.m. (strokes per minute), the sewing machine must be operated at 3,000 s.p.m. to effectively operate the apparatus for terminating the last stitch at a predetermined point. As a result, where the stitch line is long, time is wasted.

SUMMARY OF THE INVENTION

With the foregoing in mind, it is an object of this invention to eliminate the above demerits of conventional apparatus for terminating the last stitch at a predetermined point.

According to this invention, although the distance M is short, the last stitch may be terminated at the predetermined point with a speed higher than the conventional speed. The present invention comprises a speed setting means to set the speed to high speed RH or to medium speed RM, a first workpiece-end detector which is located at a distance M from the needle entry in the counter-feed direction and which generates a first signal, a second workpiece-end detector which is located at distance L from the first workpiece-end detector in the counter-feed direction and which generates a second signal, a high-speed RH stitching means which operates at high-speed RH when the sewing machine is started, a medium-speed RM stitching means which operates when the second workpiece-end detector generates the second signal, a terminating means which starts working when the first workpiece-end detector generates the first signal to terminate the last stitch at a predetermined point.

The medium speed RM stitching means comprises a memory which stores the distance L which is the distance between the first and second workpiece-end detectors and also stores the necessary number of stitches R required to slow from high speed RH operation to medium speed RM operation, a detecting means which detects the original stitch-pitch P, an operation means which operates $L/P=D$ which is the number of stitches to be stitched at the medium speed RM and also operates $D-R=H$ which is the number of stitches to be stitched at high speed RH operation, a stitching means which stitches H number of stitches at high speed RH, and a speed setting means which sets the speed from RH to RM when the H number of stitches is finished.

The sewing starts with high speed RH and when the second workpiece-end detector detects the end of the workpiece, the speed switches to medium speed RM. When the first workpiece-end detector detects the end of the workpiece, the terminating means starts to terminate the last stitch at the predetermined point. Additionally, when the second workpiece-end detector detects the end of the workpiece and generates the second signal, if the original stitch-pitch P is small, the number of stitches L/P will be larger than the necessary number of stitches R required to reduce from speed RH to speed RM, and $L/P-R=H$ will be operated. In such a case, the speed switching from RH to RM will be conducted after completing a number H more stitches at high speed RH.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
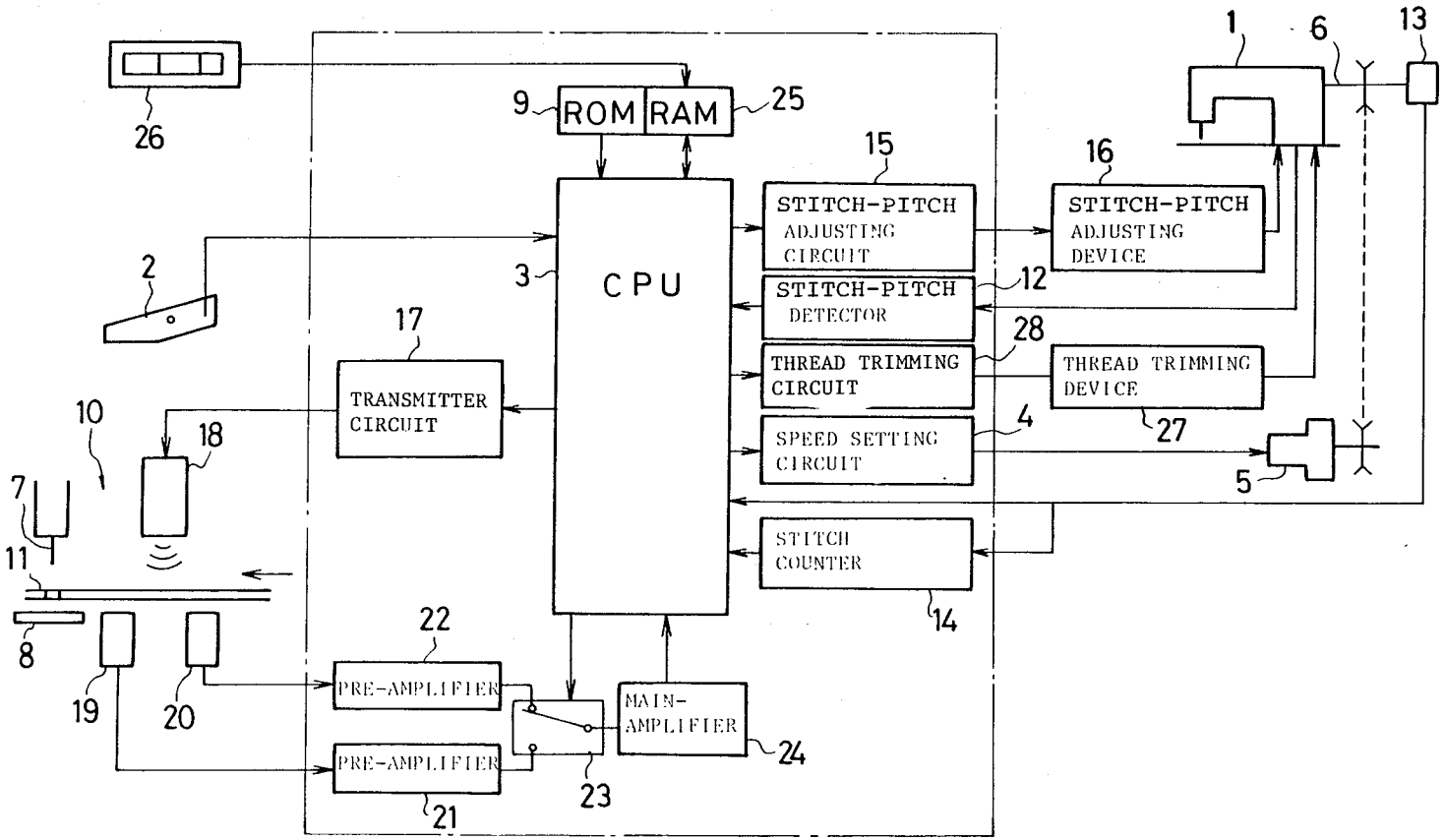
FIG. 1 is a explanatory schematic drawing according to this invention.

One preferred embodiment according to this invention will be explained hereinafter. FIG. 1 is a schematic drawing of a sewing machine equipped with an apparatus for terminating the last stitch at a predetermined point according to this invention. A sewing machine 1 is started by a pedal switch 2 which inputs a start signal to a CPU (Central Processing Unit) 3. A speed setting circuit 4 drives a motor 5 and, in connection with a main shaft 6, a needle 7 penetrates a workpiece vertically in cooperation with a hook (not shown). A dog feed 8 makes a four-step motion and thereby the stitching work is conducted.

A program stored in a ROM (Read Only Memory) 9 starts execution after receiving the signal of a workpiece-end detector 10 and causes the last stitch to be terminated at the predetermined point. A stitch-pitch detector 12 detects the original stitch pitch P which was adjusted by turning a feed-regulating dial (not shown). A pulse detector 13 detects the phase angle of a main shaft 6. The CPU 3 operates the to-be-adjusted stitch pitch to terminate the last stitch at the predetermined point. A stitch pitch adjusting circuit 15 causes a stitch pitch adjusting device 16 to adjust the stitch pitch and the stitch pitch at the dog feed 8 is thereby adjusted. A stitch counter 14 stops the sewing machine when it counts the required number of stitches to finish. Thus, the last stitch will be terminated at the predetermined point. A workpiece-end detector 10 comprises a transmitter 18 which transmits light or an ultrasonic wave and is activated through a transmitter circuit 17 connected to the CPU 3 and two receivers (first receiver 19, second receiver 20). The transmitter 18 is located in the counter-feed direction from a needle entry 11 and is facing down the workpiece.

Figure 2A:
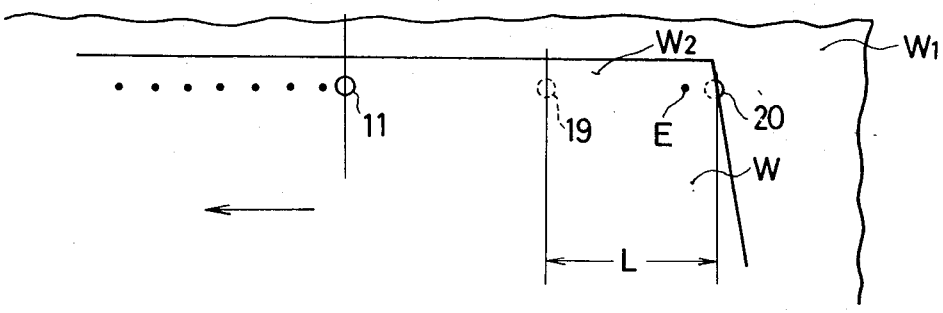
FIG. 2A, FIG. 2B, and FIG. 2C are explanatory drawings showing the relative positions of the first and second workpiece-end detectors, the end of the workpiece, the stitch line, and the needle entry.
Figure 2B:
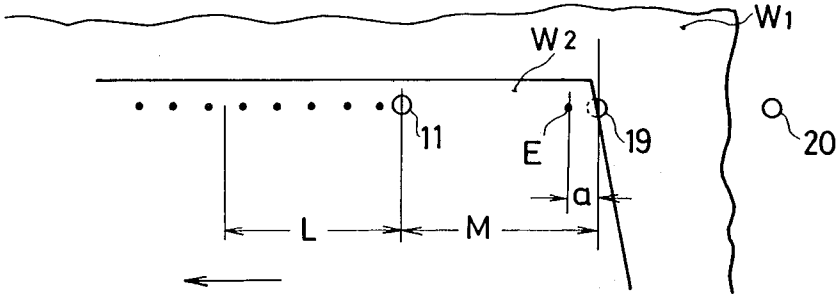

Referring to FIG. 2B, the first receiver 19 is located at a distance M from the needle entry 11. The margin of the predetermined point E is a. Referring to FIG. 2A, the second receiver 20 is located at a distance L from the first receiver 19 in the counter-feed direction. Each receiver 19, 20 generates a signal when it detects the end of the workpiece and each such signal is amplified by pre-amplifiers 21, 22, respectively. A detector-switching circuit 23 switches the signal in response to the CPU 3 and the switched signal is input to the CPU 3 through a main amplifier 24. A speed setting circuit 4 is constituted such that the stitching speed is switchable to high speed RH or medium speed RM. A RAM (Random Access Memory) 25 stores the distances L, M, a, and the necessary number of stitches R required to reduce the speed from high speed RH medium speed RM, and these are stored by an operation switch 26. Numeral 27 denotes a thread trimming device which trims the thread in cooperation with the needle action and is operated by a signal from a thread trimming circuit 28.

Figure 2C:
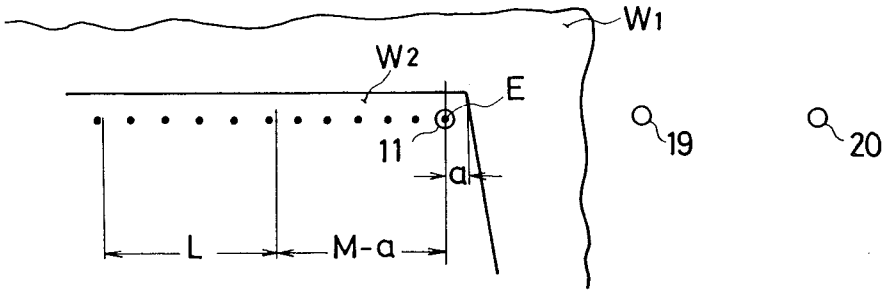

Referring to FIG. 2A–FIG. 2C, the stitching according to this invention will be explained hereafter. In this case, a pocket workpiece $W_2$ is overlapped on a shirt workpiece $W_1$ and is to be sewed. The last stitch point E is predetermined at a margin "a" from the end of workpiece $W_2$. The stitch pitch P is set by a feed-regulator dial of a type which is well known to those skilled in the art. The stitch line is passed under a needle entry 11 and the direction of the stitch line is parallel with the feeding direction. A presser foot (not shown) presses the workpieces $W_1$, $W_2$ and the sewing starts.

Figure 4A:
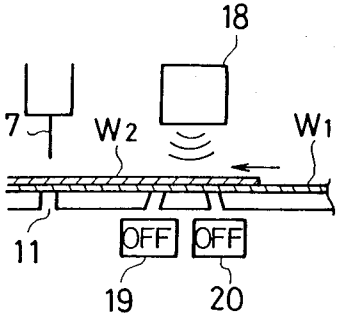
FIG. 4A, FIG. 4B, and FIG. 4C are explanatory drawings for a workpiece-end detector.
Figure 4B:
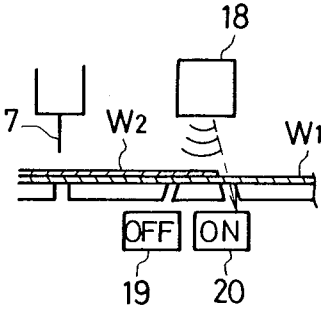
Figure 4C:
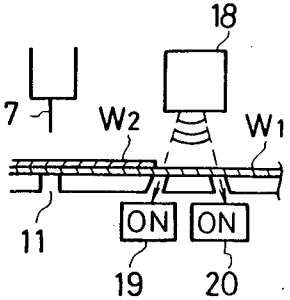
Figure 5:
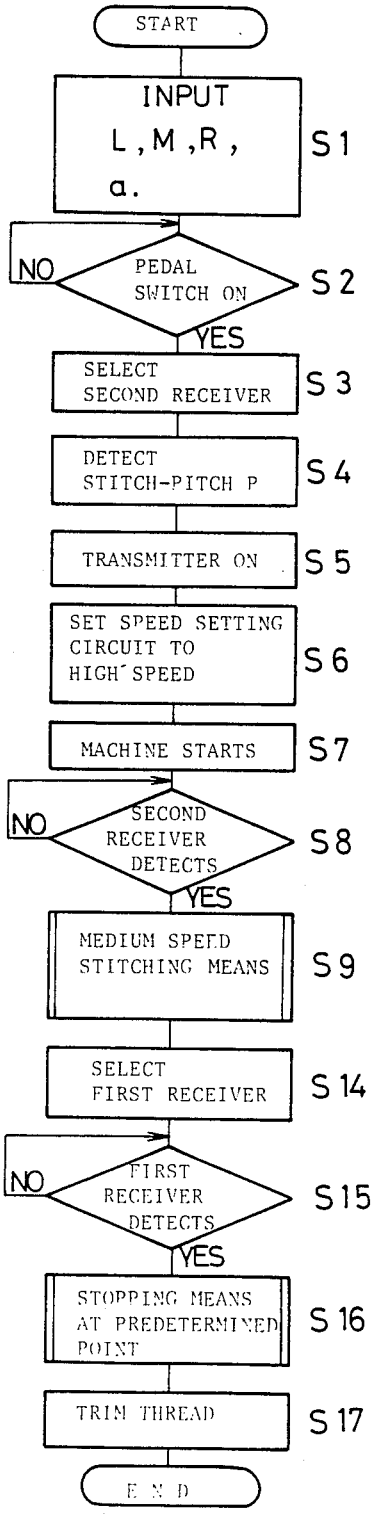
FIG. 5 and FIG. 6 are flow charts according to this invention.

Referring to FIG. 3–FIG. 6, the operation of this invention will be explained hereinafter. Referring to FIG. 5, the operation flow diagram will hereinafter be explained.

(STEP 1)

An operator inputs the values of L, M, R, and a to RAM 25 by the operation switch 26.

(STEP 2)

The pedal switch 2 is pressed.

(STEP 3)

The CPU 3 switches the detector-switching circuit 23 to the second receiver 20.

(STEP 4)

The stitch pitch detector 12 detects the stitch pitch P which was set by the feed-regulator dial (not shown) and this value P is input to RAM 25.

(STEP 5)

The transmitter circuit 17 operates and the transmitter 18 is in the "on" condition.

(STEP 6)

The speed setting circuit 4 operates and the speed is set at high speed RH.

(STEP 7)

The sewing machine starts at the high speed RH. Thus, the high speed stitching means comprises the speed setting means 4, the motor 5, and the sewing machine 1. At the start of stitching, the two workpieces $W_1$, $W_2$ are overlapped, the receiver cannot detect the signal, and the CPU 3 does not detect the end of the workpiece $W_2$. Such a condition is shown in FIG. 4A.

(STEP 8)

The stitching process advances and reaches the position as shown in FIG. 4B. The second receiver 20 detects the end of the workpiece and the CPU 3 detects the end of the workpiece.

(STEP 9)

Figure 6:
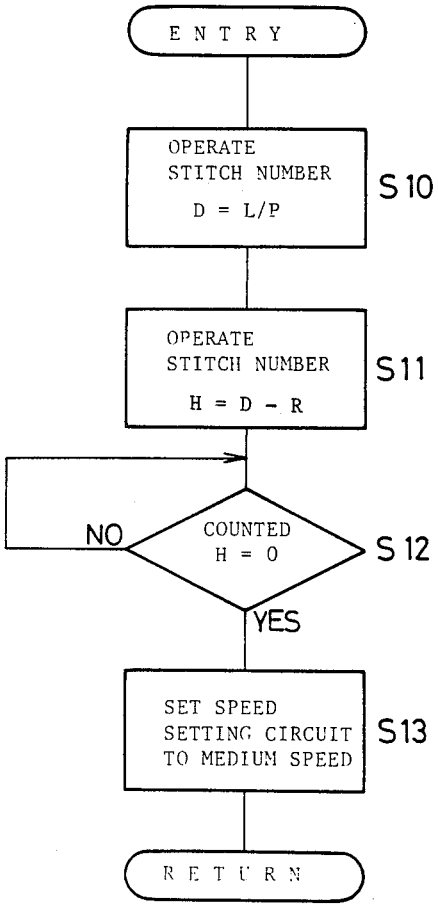

The CPU 3 operates the medium speed stitching means to reduce the stitching speed from high speed RH to medium speed RM as shown in FIG. 6.

(STEP 10)

Referring to FIG. 6, the number of stitches D at the decreasing speed is operated, namely $L/P=D$.

(STEP 11)

The difference H between the number of stitches R required to reduce the speed from RH to RM and the above-described number of stitches D is operated, namely $D-R=H$.

(STEP 12)

Figure 3:
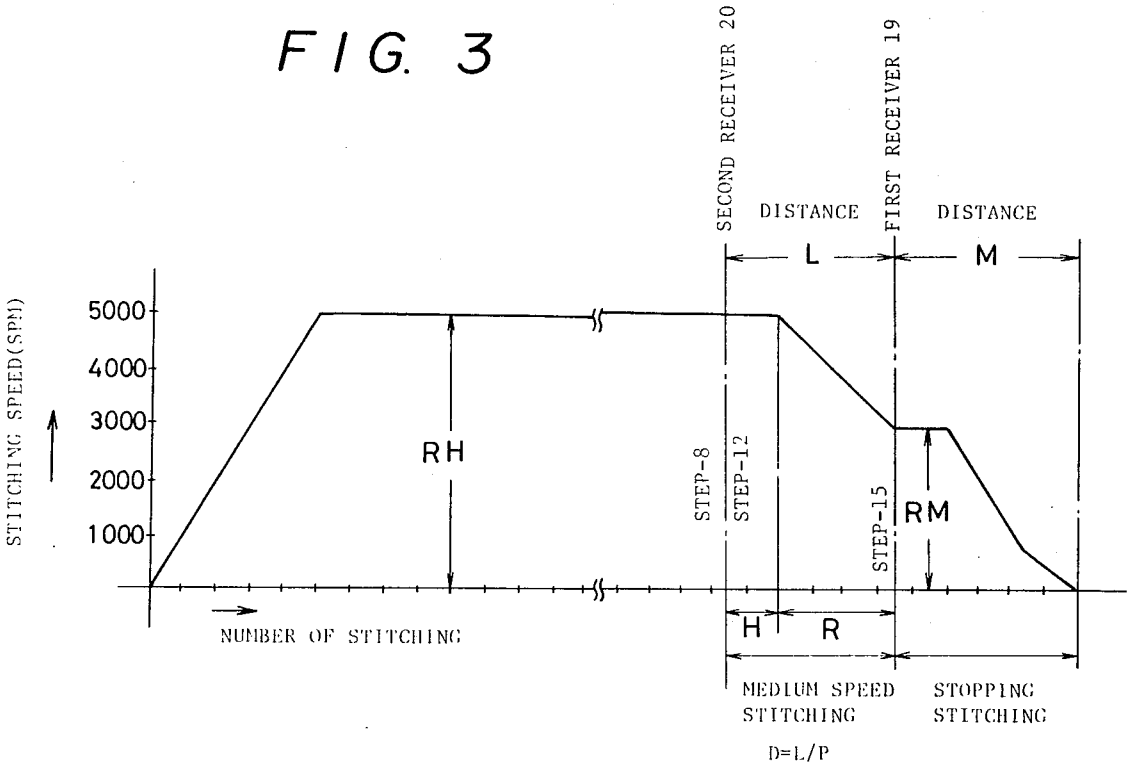
FIG. 3 is a speed diagram of stitching according to this invention.

Referring to FIG. 3, H number of stitches at high speed RH is conducted although the CPU 3 detects the end of the workpiece. The stitching with high speed RH continues until the stitch counter 14 counts down from H to zero.

(STEP 13)

The speed setting circuit 4 is set to medium speed RM and the stitching at speed RM starts. Accordingly, the medium speed stitching means comprises the controlling of stepping from Step 10 to Step 13, the speed setting means 4, the motor 5, and the sewing machine 1.

(STEP 14)

The detector-switching circuit 23 is switched to the first receiver 19.

(STEP 15)

The stitching at medium speed RM continues until the first receiver 19 detects the end of the workpiece $W_2$ as shown in FIG. 4C. and the first receiver 19 generates a first signal.

(STEP 16)

Stopping means at the predetermined point operates. The stitch pitch adjusting circuit 15 works and, adjusting the stitch pitch and reducing the speed, the last stitch will be terminated at the predetermined point. This particular process is further explained in U.S. patent application No. 4,732,095 to the same assignee, TOKYO JUKI INDUSTRIAL CO., LTD., the disclosure of which is incorporated herein by reference.

(STEP 17)

The CPU orders the thread trimming circuit 28 to operate the thread trimming device 27 and the thread is cut. Thus, the stitching process ends.

Referring to FIG. 3, two workpiece-end detectors 19, 20 are used. The second workpiece-end detector 20 is used to reduce speed from 5,000 s.p.m. (strokes per minute) to 3,000 s.p.m.. The first workpiece-end detector 19 is used to terminate the last stitch at the predetermined point. Thereby, although the distance M between the first workpiece-end detector 19 and the last stitch point (predetermined stopping point) is small, the last stitch will be terminated at the predetermined point since the stitching speed has been reduced low enough previously. Additionally, stitching can be operated at high speed 5,000 s.p.m. until the second workpiece-end detector 20 detects the end of the workpiece. Thus, stitching work is speeded up. Also, when the second workpiece-end detector 20 detects the end of the workpiece and stitching at medium speed of 3,000 s.p.m. starts, if D number of stitches at medium speed, namely $D=L/P$, is larger by H stitches than the necessary number of stitches R which is the required number of stitching to reduce from high speed RH (5,000 s.p.m.) to medium speed RM (3,000 s.p.m.), the high speed RH stitching continues H more stitches and then reduces to RM speed, namely $D-R=H$. Thereby, stitching work is speeded up.

As many apparently widely different embodiments of the invention may be made without departing the spirit and scope thereof, it is to be understood that invention is not limited to the specific embodiment thereof except as defined in the appended claims.

What is claimed is:

1. In a sewing machine, an apparatus for terminating the last stitch at a predetermined point on a workpiece, comprising:

speed setting means for setting either high speed or medium speed operation of the sewing machine, a first detector located behind a needle entry in the workpiece feed direction for detecting an end of the workpiece and generating a first signal in response thereto, a second detector located at a predetermined distance behind said first detector in the workpiece feed direction for detecting the end of said workpiece and generating a second signal in response thereto, said predetermined distance being sufficient to reduce from high speed to medium speed operation, first stitching means for stitching at high speed operation when the sewing machine starts, calculating means for calculating a number of stitches by subtracting the number of stitches required to reduce from high speed to medium speed operation from the number of stitches to be conducted at medium speed operation over said predetermined distance and generating a third signal indicative thereof in response to said second signal, second stitching means responsive to said third signal for successively stitching at high speed operation to stitch a length corresponding to said calculated number of stitches and then stitching at medium speed operation, and means for terminating the stitching in association with said first signal.

2. An apparatus for terminating the last stitch at a predetermined point on a workpiece according to claim 1, further comprising a pitch detector for detecting a stitch pitch during stitching operation, and said calculating means including memory means for storing said predetermined distance between said first detector and said second detector, means for determining said number of stitches necessary to reduce from high speed to medium speed operation, and means for dividing said predetermined distance by said stitch pitch to determine number of stitches to be conducted at medium speed over said predetermined distance.

* * * * *